US006189826B1

(12) United States Patent
Oberstrass

(10) Patent No.: US 6,189,826 B1
(45) **Date of Patent: *Feb. 20, 2001**

(54) APPARATUS AND METHOD FOR GUIDING AND CUTTING A CONTINUOUSLY ADVANCING YARN DURING A WINDING PROCESS

(75) Inventor: Detlev Oberstrass, Velbert (DE)

(73) Assignee: Barmag AG, Remscheid (DE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/191,185

(22) Filed: Nov. 13, 1998

(30) Foreign Application Priority Data

Nov. 14, 1997 (DE) ..... 197 50 510
Jun. 15, 1998 (DE) ..... 198 26 536

(51) Int. Cl.[7] ..... B65H 67/04

(52) U.S. Cl. ..... 242/473.8; 242/474.7; 242/476.4; 242/476.5

(58) Field of Search ..... 242/125.1, 473.7, 242/473.8, 474.7, 476.4, 476.5, 488

(56) References Cited

U.S. PATENT DOCUMENTS 3,899,140 * 8/1975 Gleyze ..... 242/476.4
4,069,983 * 1/1978 Muramatsu et al. ..... 242/473.7
4,340,187 * 7/1982 Schippers et al. ..... 242/473.7
4,948,057 8/1990 Greis .
5,005,776 * 4/1991 Schwarz ..... 242/488 X
5,150,845 9/1992 Colli et at. .
5,330,115 7/1994 Mayer et al. .
5,465,916 * 11/1995 Konig ..... 242/125.1 X
5,549,254 * 8/1996 Menegatto ..... 242/125.1 X
5,639,037 * 6/1997 Maragone et al. ..... 242/477.7
5,918,829 * 8/1999 Fah ..... 242/481.4

FOREIGN PATENT DOCUMENTS 0 282 105 9/1988 (EP) .
0 311 827 9/1988 (EP) .
42 26 364 9/1993 (EP) .
2 247 906 5/1975 (FR) .
2 374 245 7/1978 (FR) .
953 221 3/1964 (GB) .

* cited by examiner

*Primary Examiner*—Michael R. Mansen
(74) *Attorney, Agent, or Firm*—Alston & Bird LLP

(57) ABSTRACT

An apparatus and method for guiding and cutting a continuously advancing yarn during a package doff in a yarn winding apparatus wherein the advancing yarn is wound on a driven bobbin tube. In this process, the yarn is guided by means of a movable yarn guide along a direction substantially parallel to the axis of the tube. Downstream of the yarn guide, a suction device is arranged, which includes a pneumatic suction inlet end and a cutter. The suction device cooperates with a transfer device, so as to cut the yarn during the package doff and receive the loose end of the advancing yarn. To facilitate a protective processing of the yarn during the package doff, during the catching, and during the winding of initial layers on a tube driven by a drive roll, the yarn guide is arranged in the path of the yarn upstream of the driven tube and the suction device downstream of the driven tube.

16 Claims, 4 Drawing Sheets

APPARATUS AND METHOD FOR GUIDING AND CUTTING A CONTINUOUSLY ADVANCING YARN DURING A WINDING PROCESS

BACKGROUND OF THE INVENTION

The invention relates to an apparatus and method for guiding and cutting a continuously advancing yarn during a package doff in a yarn winding apparatus.

The apparatus and method are known from EP 0 311 827. In textile machines, for example, a crimped yarn is continuously wound to a package. After the package is fully wound, same is doffed. To this end, it is necessary to first cut the yarn, so that the full package with the loose yarn end can be replaced with a new empty tube. During the doff, the yarn end of the continuously advancing yarn is received and removed by a pneumatic suction device. After the package is doffed, the yarn is caught by means of a catching device and wound on the new tube.

In the apparatus disclosed in EP 0 311 827 and by the known method, the yarn is guided, after the package is fully wound, by means of a movable yarn guide outside the winding range to a suction device laterally arranged next to the winding range. After the package is doffed and the new tube is ready for catching the yarn, the yarn guide swings back to the winding range. To transfer or respectively catch the yarn, same is deflected by means of a transfer device between the suction device and the yarn guide, and presented for catching to the catching device.

The known apparatus and the known method have the disadvantage that at the end of the winding cycle, the loose yarn end on the fully wound package lies there against in an undefined manner, which complicates locating the loose yarn end in particular during further processing.

Furthermore, the deflection of the yarn by the transfer device for purposes of catching the yarn leads to considerable loopings which result, when compared to the winding tension, in major tension fluctuations of the yarn. Such fluctuations in the tension may lead to a formation of laps on preceding feed elements.

It is accordingly an object of the present invention to provide an apparatus and a method of the initially described type which ensure that the yarn is guided as gently as possible while doffing the package, catching the yarn, and winding initial layers thereof.

A further object of the invention is to ensure that after cutting the yarn, the loose yarn end lies against a tie-off wind on the full package.

SUMMARY OF THE INVENTION

The above and other objects and advantages of the present invention are achieved by the provision of a yarn winding apparatus which comprises a bobbin tube mounting device for rotatably supporting a bobbin tube, and with the mounting device being movable between a winding position wherein the bobbin tube is in contact with a drive roll so as to rotate the tube, and a withdrawn position wherein the bobbin tube is separated from the drive roll. A yarn traversing device is provided for traversing the advancing yarn along a winding range on a bobbin tube which supported by the mounting device at the winding position to form a wound package. Also, a yarn guide is mounted upstream of the bobbin tube located at the winding position so as to be movable by a drive along a direction parallel to the axis of the bobbin tube, and a cutting and suction device is mounted downstream of the bobbin tube. Further, a transfer device is mounted for movement to an operative position wherein, when the bobbin tube mounting device moves a full package to its withdrawn position, the transfer device deflects the advancing yarn into contact with the cutting and suction device.

The cutting and suction device is located in a transfer plane which is within the winding range, and the yarn guide is movable into the transfer plane. Also, the transfer device includes a gripping arm having a free end which is within the transfer plane when the transfer device is moved to its operative position.

The yarn guide and the suction device are arranged within the winding range. In this connection, the winding range is the range on the tube which is covered by the traversed yarn. This allows the yarn to be cut with relatively little deflection and to recatch same thereafter. Thus, no significant yarn tensions occur during the doffing phase. The suction device is arranged preferably stationarily. In the case of a suction device constructed for movement substantially parallel to the package there is the possibility of placing the loose yarn end with the tie-off wind in any desired position within the winding range. Furthermore, the additional mobility of the suction device imparts a high flexibility to the configuration of the catching device.

In a particularly advantageous embodiment of the apparatus, the yarn guide and the suction device may be arranged in a transfer plane, so that the loose yarn end on the full package can be reliably deposited on the tie-off wind. Furthermore, a simple swing movement of the transfer device permits the yarn to be guided into the cutter of the suction device. In this process, only one deflection is needed in the transfer plane. The gripping arm of the transfer device engages the yarn as it advances between the package that is already raised and the yarn guide. This arrangement has furthermore the advantage that when raising the package from the drive roll, the transfer device causes the yarn to remain safely guided in the yarn guide. Preferably, the transfer plane is formed as a normal plane of the package and includes the tie-off wind of the package.

The inlet end of the suction device and the cutter may be arranged one after the other in the transfer plane. This ensures that the yarn is already engaged by the pneumatic suction inlet opening before entering into the cutter. Thus, after being separated in the cutter, the end of the advancing yarn is safely received and removed. To this end, the cutter has preferably a cutting blade which cooperates with the gripping arm of the transfer device such that the yarn is cut clean and safely by the cutting blade.

To guide the yarn safely into the opening of the suction inlet, it is advantageous to make same slotted in the direction of the advancing yarn and arranged in alignment with a cutting blade of the cutter.

For catching the yarn, the yarn guide and the suction device are arranged relative to each other such that the catching device extends in the path of the yarn between the yarn guide and the suction device. This arrangement facilitates catching of the yarn in the catching device without additional auxiliary means alone by the movement of the yarn guide. To this end, the yarn is deflected only in the longitudinal direction parallel to the tube. By an additional, equidirectional movement of the suction device it is also made possible to minimize the deflection of the yarn.

In the winding apparatus of the present invention, wherein the tube is mounted between two clamping plates arranged on a package holder, and the catching device is formed on one of the clamping plates, it is possible to catch the yarn in a simple manner. To this end, the yarn is obliquely guided over the front edge of the clamping plate, so that the yarn automatically drops into a catching slot arranged in the front edge of the clamping plate. Furthermore, the arrangement of the yarn guide and the catching device is advantageous in such a manner that the yarn and the clamping plate perform an equidirectional movement. This prevents the yarn from sagging and, thus, from undergoing an excessive fluctuation in tension.

In the case of the previously described operations concerning doffing a package, catching the yarn, and winding first layers thereof, it is presumed that at the beginning of the package doff, the yarn is guided on a traversing yarn guide by means of an auxiliary device, and that it is subsequently received by the yarn guide. In this instance, it is preferred to provide the yarn guide with a drive which moves the yarn guide in the longitudinal direction parallel to the tube, and the movement of the yarn guide is performed in each direction at a variable speed. In this case, the drive may, for example, be a linear drive.

In a particularly advantageous further development of the invention, the yarn guide is realized by a traversing yarn guide of a yarn traversing device. To this end, the traversing yarn guide may guide the yarn outside and inside the winding range in the longitudinal direction parallel to the tube. This embodiment has the advantage that no additional control unit is needed for controlling the traversing device. All operations during the winding, during the package doff, and during the catching are controlled via a controller of the traversing device.

After the yarn has been caught and initial layers thereof have been wound on the tube, the actual winding cycle starts, i.e., the winding of the package. After the package is fully wound, the yarn is taken over by the suction device for purposes of initiating the package doff. To this end, the traversing yarn guide that guides the yarn stops in a transfer plane. The transfer device then guides the yarn into the suction device. After the package is doffed and the empty tube is clamped in the package holder between the clamping plates, the threadup of the yarn is started. To this end, the tube is initially accelerated to a rotational speed necessary for the threadup. As soon as the rotational speed is reached, the drive of the traversing yarn guide will be activated, and the traversing yarn guide guides the yarn to a catching position, in which the yarn advances obliquely across a catching plane of the catching device, for example, a front edge of the clamping plate.

The drive of the yarn guide may be controllable by a controller, which is connected to a sensor that senses the rotational speed of the tube. This construction is especially advantageous, when it comes to catch the yarn by means of the catching device without a time delay, immediately after reaching the winding speed necessary for the winding, and to wind the yarn on the tube. To this end, the rotational speed of the tube is continuously sensed. As soon as a predetermined winding speed is reached, the drive of the yarn guide will be activated. The yarn guide then performs the corresponding movements for catching the yarn and for winding initial layers of same on the tube. The winding speed corresponds to the rotational speed of the tube, which generates a circumferential speed on the tube that is substantially equal to the yarn speed.

This embodiment also presents the possibility of advancing the sequence of motions of the yarn guide even to the acceleration or deceleration phase of the tube. This will be especially advantageous in cases, in which the yarn is initially caught in the catching device on a larger diameter than the tube diameter. For purposes of maintaining a substantially constant winding speed of the yarn, it will therefore be necessary that the catching device operating at the rotational speed of the tube be driven during the catching at a lower speed than the winding speed.

The sensor may be designed to sense the position of the catching groove in the catching device. This has the advantage that the yarn is caught by the catching device without a significant delay immediately upon reaching a catching position of the yarn guide. Since the yarn continues to be guided in the suction device until it is caught, this embodiment will result in a reduction of the amount of yarn that goes to waste.

BRIEF DESCRIPTION OF THE DRAWINGS

In the following, the apparatus of the present invention as well as the method are described in more detail with reference to the embodiments illustrated in the attached drawings, in which.

DETAILED DESCRIPTION OF THE PREFERRED EMBODIMENTS

Figure 1:
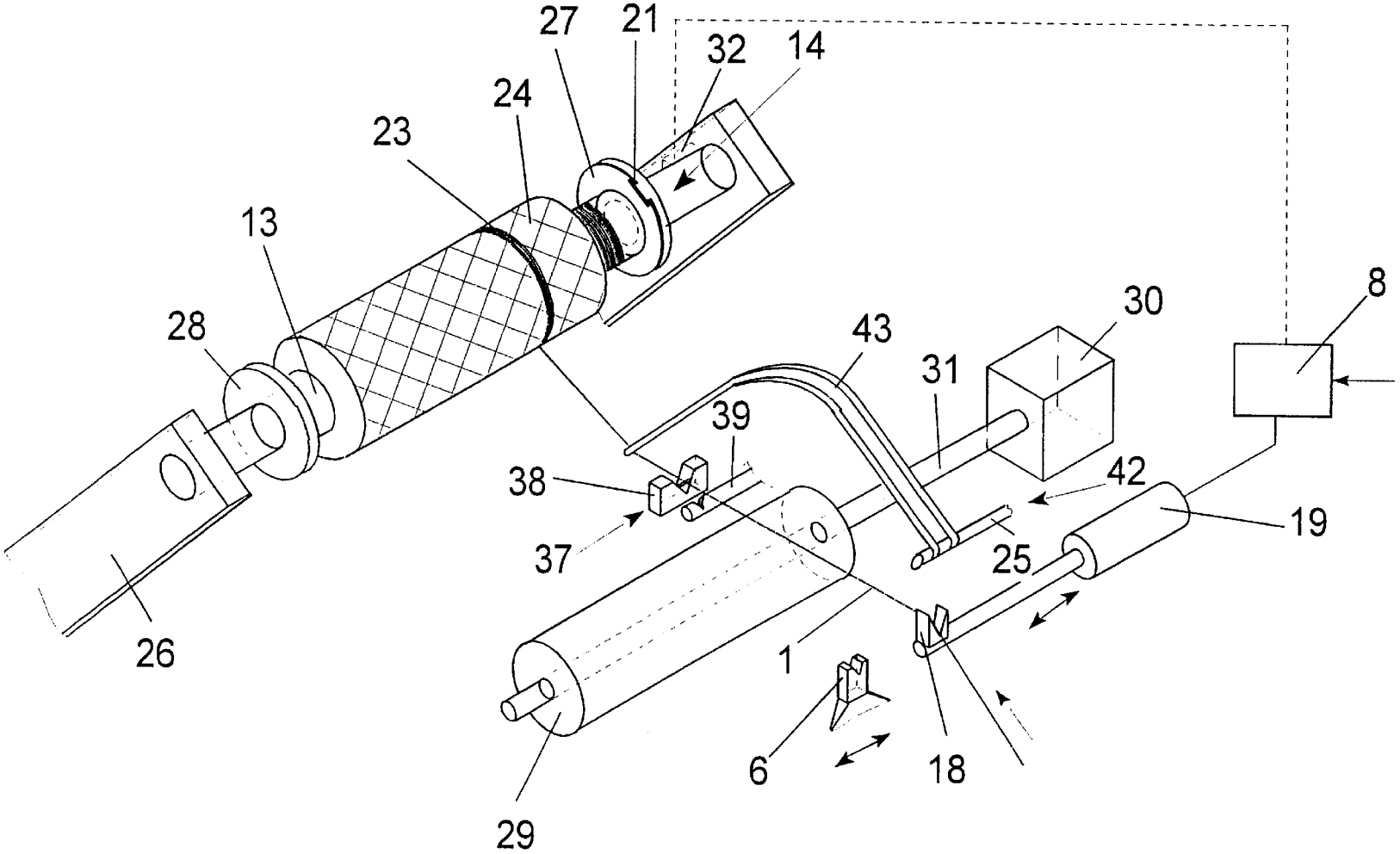
FIG. 1 is a schematic view of a first embodiment of a yarn winding apparatus according to the invention during a package doff.
Figure 2:
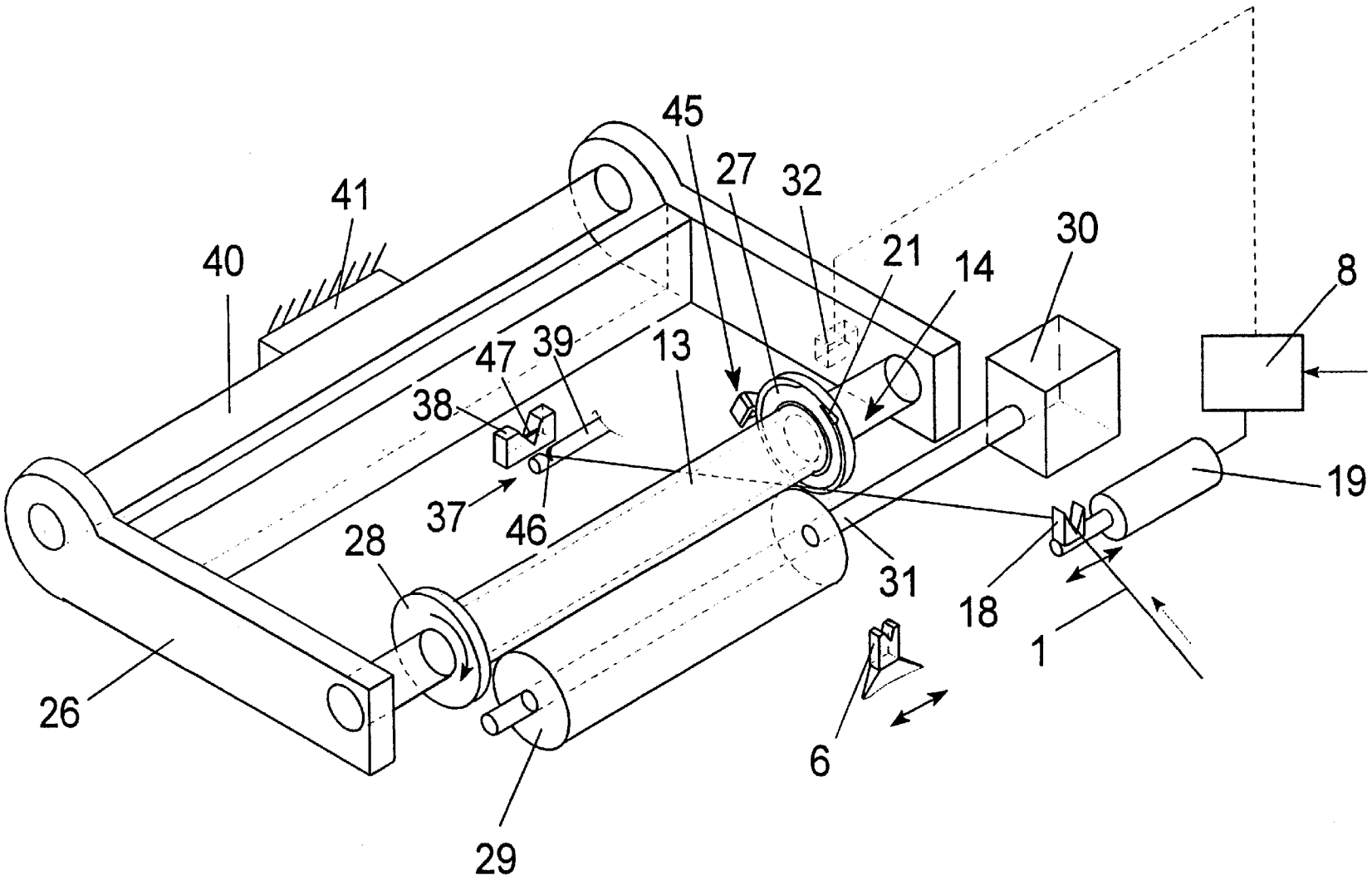
FIG. 2 is a schematic view of the apparatus of FIG. 1 during the catching of the yarn.

FIGS. 1 and 2 show a first embodiment of an apparatus in accordance with the invention within a winding apparatus as may be used, for example, in a texturing machine. The following description will therefore apply to FIGS. 1 and 2, unless otherwise specified.

The winding apparatus comprises a rotatable package holder 26, which is mounted on a swing axle 40 secured to a machine frame 41. On the free ends of the fork-shaped package holder 26, two opposite clamping plates 27 and 28 are mounted for rotation. Between the clamping plates 27 and 28 a bobbin tube 13 extends for receiving a package. To this end, the clamping plates 27 and 28 are each provided with a conical centering extension which extends in part into the tube end. With these extensions, the tube 13 is centered between the clamping plates 27 and 28. A drive roll 29 lies against the surface of tube 13. The drive roll 29 is mounted on a shaft 31. The shaft 31 is connected at its one end to a motor 30. The drive roll motor 30 drives roll 29 at a substantially constant speed. By frictional engagement via drive roll 29, the tube 13 is accelerated to a winding speed, so that the yarn 1 on tube 13 is wound to a package. To this end, a traversing yarn guide 6 is arranged in the path of the yarn upstream of drive roll 29. The traversing yarn guide is connected to a drive, which oscillatingly drives the traversing yarn guide 6 within the winding range. The traverse drive may be formed by a cross-spiralled roll or a belt drive.

Between the yarn guide 6 and tube 13 a movable yarn guide 18 is arranged. The yarn guide 18 is connected to a drive 19 which reciprocates the yarn guide 18 in a plane parallel to the tube 13 such that the yarn guide 18 can be positioned both inside the winding range and outside the winding range. The drive 19 is connected to a controller 8. The controller 8 may optionally be connected to a sensor 32 arranged on package holder 26. The sensor 32 is arranged in the region of clamping plate 27 and senses the position of a groove 21 of a catching device 14. The catching device 14 is formed on clamping plate 27. The sensor 32 may, for example, be a pulse generator which releases per revolution a signal as a function of the catching groove 21. These pulses are converted in controller 8 for evaluating the position of the catching groove and the rotational speed of tube 13. The tube 13 is clamped between plates 27 and 28 such that the clamping plates 27 and 28 rotate without slip at the rotational speed of tube 13.

A suction device 37 is arranged on the side of the tube 13 opposite to the traversing device. The suction device 37 comprises a cutter 38 and a suction inlet end 39. The suction inlet end 39 is arranged between cutter 38 and tube 13, and possesses a slotted suction opening 46 which is in alignment with a cutting blade 47 of cutter 38.

In the situation shown in FIG. 1, a package doff is imminent in the winding apparatus. To initiate the package doff, the yarn guide 18 is brought by means of drive 19 to a transfer plane in the winding range. At the same time, an auxiliary device (not shown) removes the yarn 1 from traversing yarn guide 6, and inserts same into the yarn guide 18. The auxiliary device may be constructed in a simple manner as a ramp which is entered into the winding range parallel to the movement of traversing yarn guide 6. Advantageously, the ramp is connected to the yarn guide 18, so that the yarn sliding on the ramp automatically drops into the guide groove of yarn guide 18.

While the yarn guide 18 is positioned in the transfer plane, a tie-off wind 23 is wound in the form of a bead on the package 24. To doff the package, the package holder 26 is rotated in the winding apparatus such that the package 24 separates from the surface of drive roll 29. Thus, the package 24 is no longer actively driven. The yarn 1 is further wound as tie-off wind 23. A transfer device 42 arranged on the side of the winding range is now activated. The transfer device 42 comprises a gripping arm 43 which extends with its free end through the transfer plane. The gripping arm 43 is rotatably supported on a swing axle 25 and moved parallel to the transfer plane by means of a drive not shown. The gripping arm 43 is dimensioned such that its free end engages the yarn between the yarn guide 18 and the package 24 and guides the yarn 1 in the transfer plane to the suction device 37. The suction 37 extends in this instance within the path of motion that is described by the free end of gripping arm 43. This allows to accomplish that the yarn 1 enters into cutter 38 and is cut by cutting blade 47. Shortly before or simultaneously, the yarn 1 enters into the slotted opening 46 of suction inlet end 39. The end of the advancing yarn is thus removed by suction directly after the cutting. The loose yarn end of the package is deposited on the tie-off wind 23 by the package 24 as it slows down. After cutting the yarn, the transfer device 42 returns to its starting position.

In the situation shown in FIG. 2, the package is already doffed, and the continuously advancing yarn is guided by the suction device 37 and the yarn guide 18. For the sake of clarity, the transfer device is not shown in FIG. 2.

The yarn 1 is continuously removed by means of a suction current through suction opening 46 in suction inlet end 39. The package 24 has been replaced with a new empty tube which is driven by drive roll 29. To thread the yarn 1 for winding on empty tube 13, it is guided by the suction device 37 through yarn guide 18. The yarn guide 18 is brought by drive 19 to a catching position outside the winding range. This catching position of the yarn guide 18 is selected such that the yarn 1 advances obliquely across the front edge of clamping plate 27, which faces the tube. Before that, the tube 13 is accelerated by the drive roll 29 lying against its circumference to a winding speed that is predetermined by the drive roll.

When a sensor 32 is used, same generates a pulse each time the catching groove 21 passes by. This pulse is supplied to controller 8. The controller 8 includes an evaluation unit which determines from the pulses entering per unit time the momentary rotational speed of clamping plate 27 and, thus, of tube 13. At the same time, each pulse indicates the position of catching groove 21. After tube 13 reaches the winding speed, and the catching groove 21 is in a position that is necessary for a reliable catching, the drive 19 of controller 8 is activated to move yarn guide 18 to its catching position. The yarn 1 is now caught by catching device 14 in clamping plate 27.

After the yarn 1 is caught by catching device 14, it is cut by a cutter 45 arranged between the yarn suction device 37 and the clamping plate 27. After the catching, the yarn guide 18 is deflected by drive 19 from its catching position to wind a yarn reserve on the tube. To this end, the yarn guide 18 is moved in direction toward the tube center. After the yarn reserve is wound, the yarn 1 is transferred to traversing yarn guide 6. To this end, it would likewise be possible to use an auxiliary device in the form of a ramp. Winding proceeds now in a new cycle.

Figure 3:
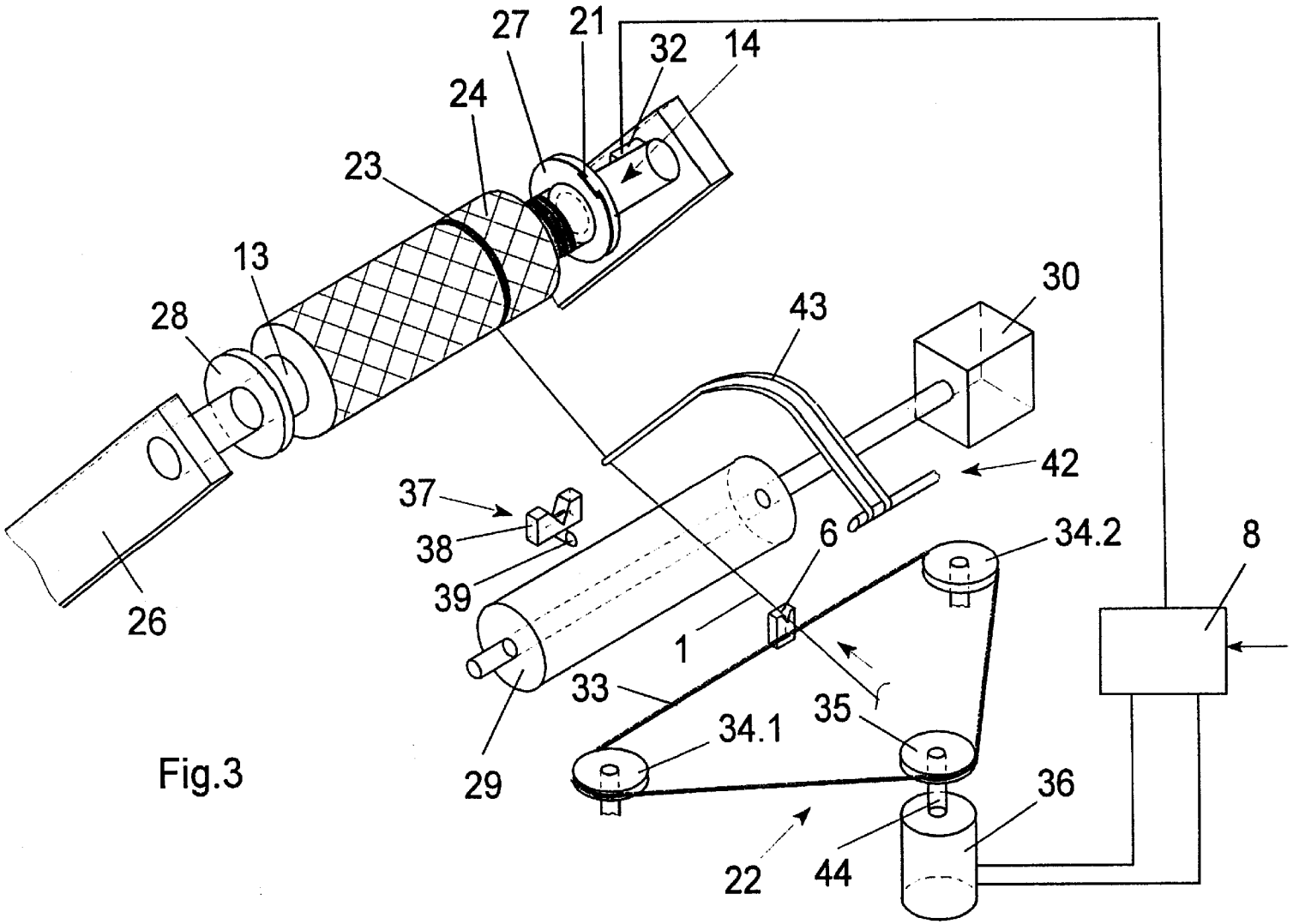
FIG. 3 is a schematic view of a further embodiment of the apparatus according to the invention during a package doff.
Figure 4:
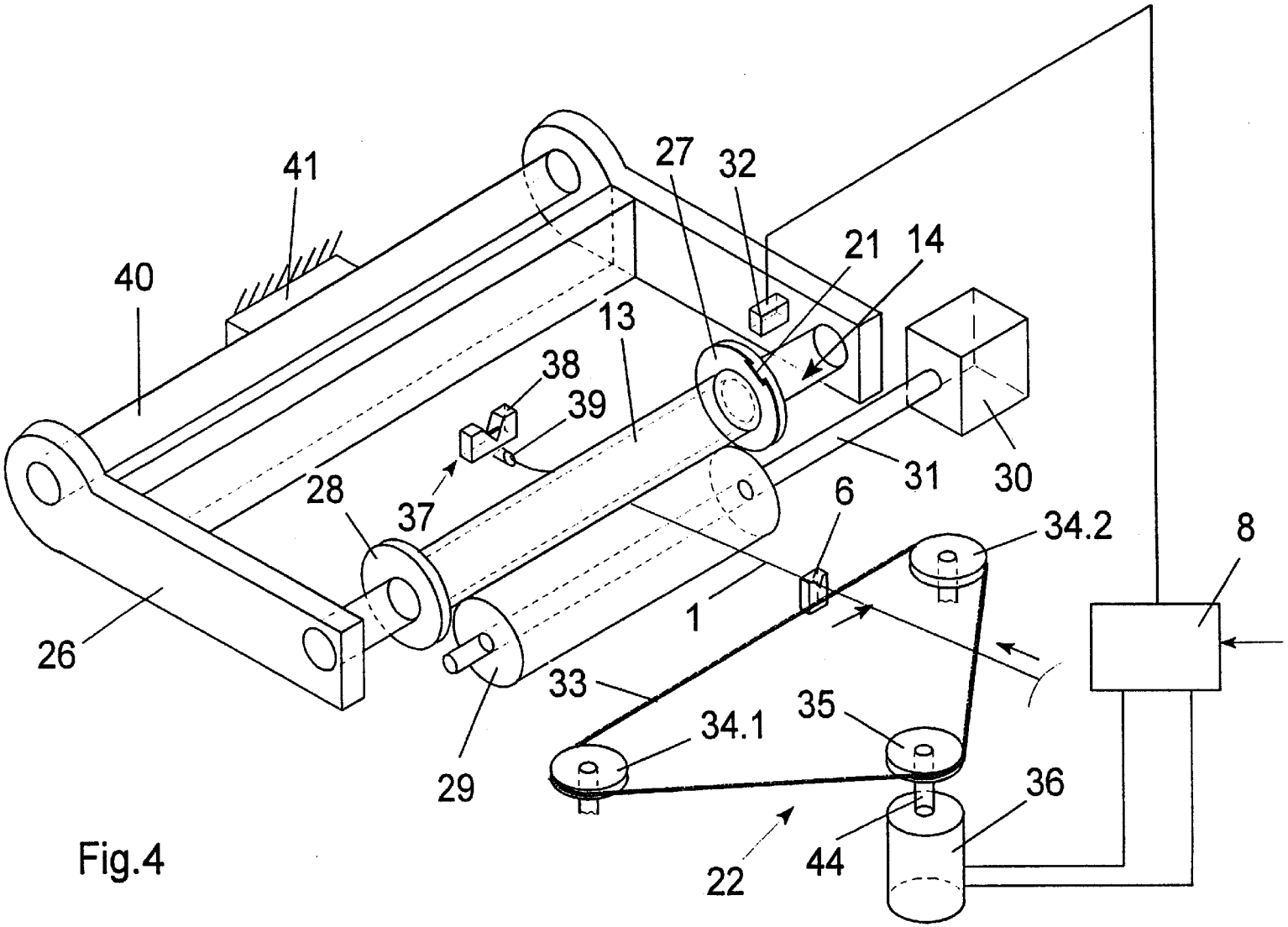
FIG. 4 is a schematic view of the apparatus of FIG. 3, during the catching of the yarn.

Shown in FIGS. 3 and 4 is a further embodiment of a winding apparatus according to the invention, as may be used for winding in a texturing machine. In this embodiment, the yarn 1 is guided by traversing yarn guide 6 for doffing a package, for catching the yarn, and for winding initial layers thereof. Since the construction of the winding apparatus differs from that shown in FIG. 1 essentially only by the traversing device, identical numerals are used for structural elements of the same function. To this extent the description with reference to FIGS. 1 and 2 is herewith incorporated by reference.

A traversing device 22 is constructed as a so-called belt drive traversing system. In this traversing system, a traversing yarn guide 6 is attached to an endless belt 33. The belt 33 extends between two deflection pulleys 34.1 and 34.2 parallel to tube 13. In the belt plane a drive pulley 35 partially looped by the belt is arranged parallel to the deflection pulleys 34.1 and 34.2. The drive pulley 35 is mounted on a drive shaft 44 of an electric motor 36. The electric motor 36 drives the pulley 35 oscillatingly, so that the traversing yarn guide 6 reciprocates in the region between the deflection pulleys 34.1 and 34.2. The electric motor 36 is controllable via controller 8. The controller 8 connects to the sensor 32 which is arranged on package holder 26 and senses the groove 21 of the catching device 14.

In FIGS. 3 and 4, the winding apparatus is shown in different operating situations. FIG. 3 shows the winding apparatus at the end of a winding cycle. After the package 24 is fully wound, the traversing yarn guide 6 is positioned in a transfer plane, and remains in this transfer plane. A tie-off wind 23 is now wound on the package 24. At the same time, the package holder 26 is rotated with the package 24 out of its operating position. A transfer device 42 now starts to act, in that a gripping arm 43 enters with its free end into the yarn path between the full package 24 and the traversing yarn guide 6. The gripping arm 43 swings from its idle position to a transfer position. In this process, it engages the yarn 1 and guides same in the transfer position to the suction device 37. In the cutter 38 the yarn is then cut and taken into suction inlet end 39. The loose yarn end is deposited on the package in the region of the tie-off wind. The package 24 can now be replaced with an empty tube. In this connection, it is of advantage that the sensor is mounted on the package holder and, thus, signals the standstill of the package in that it discontinues to generate pulses. Thus, it is possible to use the sensor signal for activating a doffing device. After the package 24 is replaced with a tube, the threadup operation starts.

FIG. 4 shows the beginning of the threadup operation. The continuously advancing yarn is guided by the suction device 37 and the traversing yarn guide 6. To this end, the yarn is sucked into an opening of the suction inlet end 39. The traversing yarn guide 6 is moved in direction of clamping plate 27 to a catching position outside the winding range. The tube 13 is accelerated by drive roll 29 in circumferential contact with same to a predetermining winding speed. Each time the catching groove 21 passes by, the sensor 32 generates a pulse which is supplied to controller 8. The controller 8 comprises an evaluation unit which determines from the pulses entering per unit time the momentary rotational speed of the clamping plate and, thus, of the tube. At the same time, each pulse indicates the position of catching groove 21. After tube 13 has reached the winding speed and the catching groove occupies a dependable position for catching the yarn, the controller 8 activates the electric motor 36 such that same moves the traversing yarn guide 6 to the catching position. The yarn 1 now intersects the catching plane of catching device 14, so that it is caught by catching groove 21. The yarn 1 is caught in catching groove 21 and cut with a cutting blade integrated in the catching device or in clamping plate 27. Such a clamping plate is disclosed, for example, in EP 0 403 949 which is herewith incorporated by reference.

After catching the yarn, the traversing yarn guide 6 is moved from the catching position to the winding range. In this process, the yarn 1 is wound on the tube 13 outside the winding range to a yarn reserve wind. The winding of the yarn reserve wind could be performed by a traversing yarn guide that remains in one position. In this instance, the yarn reserve wind will have a number of parallel winds. However, the traversing yarn guide 6 may also be moved at a speed defined by electric motor 36 to the winding range, so that side-by-side winds are produced in the yarn reserve wind. As soon as the yarn guide reaches the winding range, the winding cycle starts. The traversing yarn 6 is then driven oscillatingly within the winding range by the yarn traversing device 22. The increasing diameter of package 24 is facilitated by a swing movement of package holder 26. To this end, the package holder 26 has biasing forces which generate on the one hand between the package 24 and the drive roll 29 a contact pressure that is necessary to drive the package, and facilitate on the other hand a swing movement of the package holder 26.

That which is claimed is:

1. An apparatus for winding a continuously advancing yarn comprising a bobbin tube mounting device for rotatably supporting a bobbin tube, and with the mounting device being movable between a winding position wherein the bobbin tube is in contact with a drive roll so as to rotate the tube, and a withdrawn position wherein the bobbin tube is separated from the drive roll, means for traversing the advancing yarn along a winding range on a bobbin tube which is supported by the mounting device at the winding position to form a wound package, a yarn guide mounted upstream of the bobbin tube located at the winding position so as to be movable by a drive along a direction parallel to the axis of the bobbin tube, a cutting and suction device mounted downstream of the bobbin tube, and a transfer device mounted for movement to an operative position wherein, when the bobbin tube mounting device moves a full package to its withdrawn position, the transfer device deflects the advancing yarn into contact with the cutting and suction device.

2. The yarn winding apparatus as defined in claim 1 wherein the cutting and suction device is located in a transfer plane which is within the winding range, wherein the yarn guide is movable into the transfer plane, and wherein the transfer device includes a gripping arm having a free end which is within the transfer plane when the transfer device is moved to its operative position.

3. The yarn winding apparatus as defined in claim 2 wherein the transfer device is mounted for pivotal movement about an axis parallel to the axis of the bobbin tube in the winding position.

4. The yarn winding apparatus as defined in claim 3 wherein the cutting and suction device is located within the radius of the pivotal movement of the free end of the gripping arm.

5. The yarn winding apparatus as defined in claim 3 wherein the cutting and suction device includes a cutting blade and a suction inlet which comprises a slot in a suction tube, with the slot being aligned in the direction of the advancing yarn and positioned in alignment with the cutting blade.

6. The yarn winding apparatus as defined in claim 3 further comprising a yarn catching device mounted adjacent one end of the bobbin tube, and wherein the yarn guide is movable to a yarn catching position wherein the yarn advancing from the yarn guide to the cutting and suction device contacts the yarn catching device.

7. The yarn winding apparatus as defined in claim 6 wherein the bobbin tube mounting device comprises a package holder having two opposing clamping plates configured to mount a bobbin tube therebetween, and wherein the yarn catching device is positioned on one of the clamping plates.

8. The yarn winding apparatus as defined in claim 7 wherein the yarn guide is movable to a transfer position within the winding range and so as to permit the formation of a tie off wind on a full package.

9. The yarn winding apparatus as defined in claim 8 wherein the yarn traversing means includes means for traversing the yarn guide within the winding range and including a reversible drive that is variable in its speed.

10. The yarn winding apparatus as defined in claim 8 wherein the yarn traversing means includes a traversing yarn guide which has a drive separate from the drive of the first mentioned yarn guide, and means for transferring the advancing yarn between the traversing yarn guide and the first mentioned yarn guide.

11. The yarn winding apparatus as defined in claim 8 wherein the drive of the yarn guide is controllable by a controller, and further comprising a sensor for sensing the rotational speed of the bobbin tube and which has an output leading to the controller, whereby the movement of the yarn guide to the catching position is controlled by the sensor.

12. A method of guiding and cutting a continuously advancing yarn during a package doff in a winding machine wherein the advancing yarn is wound on a bobbin tube which is rotatably driven by a drive roll and comprising the steps of traversing the advancing yarn along a winding range on the bobbin tube to form a wound package, upon the package becoming full, guiding the yarn in a transfer plane which is within the winding range so as to form a tie-off wind and including contacting the yarn with a yarn guide, removing the full package from the drive roll, and engaging the advancing yarn between the full package and the yarn guide with a transfer device which is movable within the transfer plane and so as to deflect the advancing yarn into contact with a cutting and suction device which is located in the transfer plane and so as to cut and remove the advancing yarn.

13. The method as defined in claim 12 comprising the further subsequent steps of moving an empty bobbin tube into contact with the drive roll so as to rotate the tube, moving the yarn guide to a catching position located outside of the winding range, so that the yarn engages a catching device located adjacent one end of the empty bobbin tube and between the cutting and suction device which is within the winding range and the yarn guide which is outside the winding range.

14. The method as defined in claim 13 wherein the step of moving the yarn guide to a catching position is controlled as a function of the rotational speed of the empty bobbin tube in such a manner that upon reaching a predetermined winding speed the yarn guide is moved to the catching position and the yarn is caught and wound in initial layers.

15. The method as defined in claim 14 wherein the catching device includes a catching groove, and wherein the position of the catching groove is sensed by a sensor which generates a signal for initiating the movement of the yarn guide to the catching position.

16. The method as defined in claim 13 comprising the further steps of withdrawing the transfer device from its position between the full package and the yarn guide to an idle position, and then traversing the yarn to form a wound package on the empty bobbin tube.

* * * * *

UNITED STATES PATENT AND TRADEMARK OFFICE

CERTIFICATE OF CORRECTION

PATENT NO. : 6,189,826 B1
DATED : February 20, 2001
INVENTOR(S) : Oberstrass

It is certified that error appears in the above-identified patent and that said Letters Patent is hereby corrected as shown below:

Title page,
Item [56] References Cited, U.S. PATENT DOCUMENTS,
Line 6, "Colli et at." should read -- Colli et al. --;
Line 10, "Maragone et al." should read -- Marangone et al. --.

Title page,
Item [56] References Cited, FOREIGN PATENT DOCUMENTS,
Line 3, "42 26 364 9/1993 (EP)" should read -- 42 26 364 9/1993 (DE) --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*